United States Patent [19]

Seragnoli et al.

[11] Patent Number: 4,545,488

[45] Date of Patent: Oct. 8, 1985

[54] DEVICE MONITORING THE QUALITY OF CIGARETTES IN A PACKAGING MACHINE

[75] Inventors: Enzo Seragnoli; Antonio Gamberini, both of Bologna, Italy

[73] Assignee: G. D. Societa per Azioni, Bologna, Italy

[21] Appl. No.: 485,167

[22] Filed: Apr. 15, 1983

[30] Foreign Application Priority Data

May 13, 1982 [IT] Italy ..... 3421 A/82

[51] Int. Cl.[4] ..... B07C 5/34; A24C 5/32

[52] U.S. Cl. ..... 209/535; 53/54; 131/282; 131/907; 209/599

[58] Field of Search ..... 209/535-537, 209/591, 599, 600; 53/54; 73/45, 45.1; 131/282, 904, 907

[56] References Cited

U.S. PATENT DOCUMENTS

| | | | |
|---|---|---|---|
| 3,207,308 | 9/1965 | Kemp | 209/535 |
| 3,237,764 | 3/1966 | Kochalski et al. | 209/535 |
| 3,368,674 | 2/1968 | Koeppe | 209/535 |
| 3,564,902 | 2/1971 | Heitmann | 73/45.1 X |
| 3,677,068 | 7/1972 | Schmermund | 131/904 X |
| 3,874,227 | 4/1975 | Focke | 209/535 X |
| 4,093,075 | 6/1978 | Molins | 209/535 |
| 4,306,445 | 12/1981 | Marsau et al. | 73/45.1 X |
| 4,363,332 | 12/1982 | Preston et al. | 209/535 X |
| 4,376,484 | 3/1983 | Seragnoli | 209/535 |
| 4,445,520 | 5/1984 | Knight et al. | 131/907 |

FOREIGN PATENT DOCUMENTS 2108818 5/1983 United Kingdom .

*Primary Examiner*—Robert B. Reeves
*Assistant Examiner*—Edward M. Wacyra
*Attorney, Agent, or Firm*—Karl F. Ross; Herbert Dubno

[57] ABSTRACT

A device for monitoring the quality of cigarettes in a packing machine, which may be mounted on an input hopper of a packing machine of cyclic type in order to monitor the quality of the cigarettes of a stack moving in steps along each output channel of the hopper and to carry out the removal of defective cigarettes, comprising, with respect to each channel, a sensor element and an associate ejector element, whose respective operating cycles take place, with respect to each cigarette, within a same cycle of this machine.

9 Claims, 6 Drawing Figures

1
2
3
4
5
6
7
8
9
10
11
12
13
14
25
37
39
40
41

DEVICE MONITORING THE QUALITY OF CIGARETTES IN A PACKAGING MACHINE

FIELD OF THE INVENTION

The present invention relates to a device for monitoring the quality of cigarettes in a packing machine.

The present invention relates in particular to a monitoring device designed to be mounted on an input hopper of a cigarette packing machine in order to detect and remove cigarettes which may be defective.

In U.S. patent specification Ser. No. 3,520,394 the name of the applicants discloses a hopper for containing a mass of cigarettes whose lower portion is sub-divided into a number of dementary branches or hoppers, normally three, equal to the number of layers of cigarettes constituting a complete group of cigarettes to be packed.

Each elementary hopper is in turn sub-divided by plates or spacers into channels having a width which is slightly greater than the diameter of a cigarette, the number of these channels corresponding to the number of cigarettes included in the corresponding layer.

At the base or discharge mouth of each of these elementary hoppers there are thus formed, on horizontal receiving plates, layers of adjacent cigarettes which a feed device supplies to the compartments of an endless conveyor moving in an intermittent manner. As a result of the superposition of these layers complete groups are gradually formed in these compartments and are transferred to packing means by the above-mentioned intermittent conveyor.

In accordance with the disclosure of the U.S. Pat. No. 4,376,484 in the name of applicants, for example, means for monitoring the quality of the cigarettes are provided in each of the said channels.

These monitoring means comprise at least a pair of sensors designed to carry out two monitoring operations during each feed step of the cigarettes along the channels themselves, and at least one ejector element disposed downstream of the sensors, which elements may be actuated by the sensors by means of an electrical circuit comprising a memory element.

Although a device of the above-mentioned type is operationally viable it is relatively complex and delicate as a result of the high number of electrical components which it contains.

OBJECTS OF THE INVENTION

The object of the present invention is to provide a device of the above-mentioned type which overcomes the drawbacks described with respect to the prior art.

SUMMARY OF THE INVENTION

These and other objects are achieved by the present invention, in that it relates to a device for monitoring the quality of cigarettes in an input hopper of a packing machine of the cyclical type, the said hopper being sub-divided, at its output end, into channels containing horizontal stacks of adjacent cigarettes which move one step during each operating cycle of the said machine with a movement which is transverse to their respective axes along the said channels, the said device comprising, for each of the said channels, at least one sensor element monitoring the quality of the cigarettes and an associated ejector element for defective cigarettes controlled by the said sensor element; the said device being characterised in that the said sensor element and the said ejector element are disposed along the said channel at positions included between the space defined by the heads of two adjacent cigarettes in order to monitor each cigarette and possibly eject it within a same operating cycle of the said machine.

BRIEF DESCRIPTION OF THE DRAWING

Further characteristic features and advantages of the present invention are shown in the following description given with reference to the attached drawings which show two non-limiting embodiments of the invention, and in which:

FIGS. 2 to 6 show the lower end of an input hopper 1, which is known per se, of a cigarette packing machine (not shown).

SPECIFIC DESCRIPTION

Figure 1:
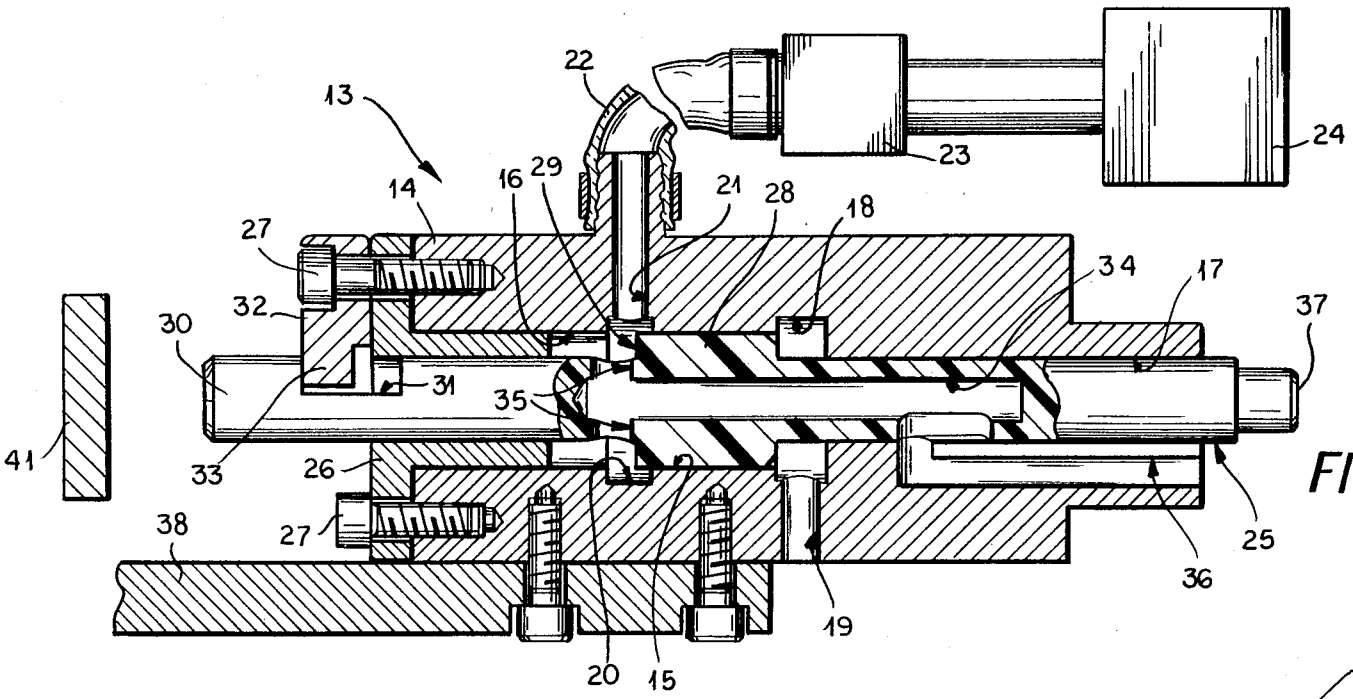
FIG. 1 is a sectional view of a device for monitoring and ejecting cigarettes constructed in accordance with the present invention.

The hopper 1 is defined by a lateral wall 2 and a lateral wall 3 which are disposed vertically and parallel to one another and define a cavity having a width which is slightly greater than the length of a cigarette 4 and is sub-divided into a plurality of elementary channels 5 (only one of which is shown) by walls 6 (only one of which is shown in the drawings) which have a spacing from one another which is slightly greater than the diameter of the cigarettes 4.

The elementary channels 5 are closed at the bottom by a horizontal wall 7 which supports the stacks of cigarettes 4 contained therein. The cigarettes 4, on contacting the wall 7, may be engaged in groups by a feed element 8, which may be displaced horizontally with an alternating movement, in a direction perpendicular to the walls 2 and 3 via horizontal slots 9 and 10 provided through the walls 2 and 3 in a position adjacent to the wall 7 and having a height which is at least equal to the diameter of the cigarettes 4.

The feed element 8 is constituted by a horizontal plate having a thickness which is substantially the same as the radius of the cigarettes 4 and is disposed in contact with the upper surface of the wall 7.

The feed element 8, whose operating cycle is subsequently identical to that of the said packing machine, may be moved between a rest position which is external to the hopper 1 and an operating position which is internal to the said hopper, in order to feed the cigarettes 4 into containers 11 (only one of which is shown) supported on a conveyor belt 12 provided with an intermittent movement and designed to supply groups of cigarettes 4 to a packing unit (not shown).

For a more detailed description of the construction of the hopper 1, the channels 5, the feed element 8 and the conveyor belt 12, reference should be made to the description and drawings of the British patent specification Ser. No. 1 211 012.

A monitoring and ejection device, designated overall by 13 and shown in detail in FIG. 1, operates at the side of each channel 5. This device 13 comprises a support block 14 having a substantially parallelepipedic shape through which passes a cavity 15 disposed perpendicular to the walls 2 and 3, having two coaxial cylindrical sections designated respectively, on the right and left-hand sides of FIG. 1, by 16 and 17.

These cylindrical sections 16 and 17, the first of which has a greater diameter, are connected, in a median zone of the block 14, by an annular groove 18 communicating with atmosphere via a hole 19 provided in the block 14 itself.

A second annular groove 20 is provided in an intermediate zone of the cylindrical section 16 and communicates, via hole 21 provided in the block 14 and a flexible tube 22 connected thereto, with a cyclical matching means constituted by a rotary distribution valve 23 leading to a compressed air source 24.

A shaft 25 is mounted in a slideable manner in the said cavity 15, one right-hand portion of which shaft is coupled with the cylindrical section 17, and one left-hand portion of which shaft passes through a bushing 26 which is fastened to the left-hand wall of the block 14 by screws 27.

An intermediate zone of the shaft 25 is provided with an enlarged cylindrical section 28, hereafter called distribution ring or means, having a diameter substantially equal to that of the section 16 of the cavity 15.

This distribution ring 28, which is part of the control means of an ejector element, which will be discussed below, is bounded on the left-hand side (with respect to the drawing) by a wall 29 and is included between the annular grooves 18 and 20.

The left-hand end of the shaft 25, designated by 30, projects from the block 14 and has an elongate cativy 31 in its upper portion.

The stop element 32, fixed to the block 14 by means of one of the above-mentioned screws 27, has a tooth 33 projecting into the cavity 31, and constitutes, in combination with latter, a guide and end of stroke element for the shaft 25. An intermediate portion of the shaft 25 has a hole 34 passing through it longitudinally, the left-hand end of this hole being connected via two holes 35 with the section 16 of the cavity 15.

The second end of the hole 34 communicates with a cylindrical conduit 36 within the block 14, hereafter called ejector element, one end of which faces the hopper 1 below the shaft 25. The centre distance between the shaft 25 and the conduit 36 is approximately of the thickness of the feed element 8.

The right-hand end of the said shaft 25 projects from the right-hand side of the block 14 and constitutes a sensor or feeler element, designated by 37, designed to check the filling of the cigarette ends 4 which pass through a channel 5 of the hopper 1.

The said blocks 14 are supported at the bottom by a support plate 38 which is horizontal and provided with an alternating movement in a direction parallel to the cigarettes 4 contained in the hopper 1, the actuation means (not shown) operating in a predetermined phase relationship with the said feed element 8.

The sensors 37 are provided with access to the cigarettes 4 moving along the channels 5 via input apertures 39 (only one of which is shown in the drawings) provided in the wall 2 via which the said ends of the conduits 36 also face towards the interior of the hopper 1.

Output apertures 40, facing the said apertures 39 in a substantially horizontal manner, are provided in the wall 3 of the hopper 1.

These apertures 40 have their upper edges disposed substantially at the same level as the axes of the shafts 25 and have a vertically extending section equal to three times the radius of a cigarette 4.

A fixed wall 41 parallel to the walls 2 and 3 is supported in a manner which is not shown opposite the ends 30 of the shafts 25. The distance between this wall 41 and the wall 2 of the hopper 1 is substantially equal to the total of the length of the shaft 25 and the stroke with which the plate 38 provides the blocks 14.

In operation, the cigarettes 4 contained in the hopper 1 are extracted successively from the base of the hopper under the action of the feed element 8.

Figures 2, 3, 4, 5:
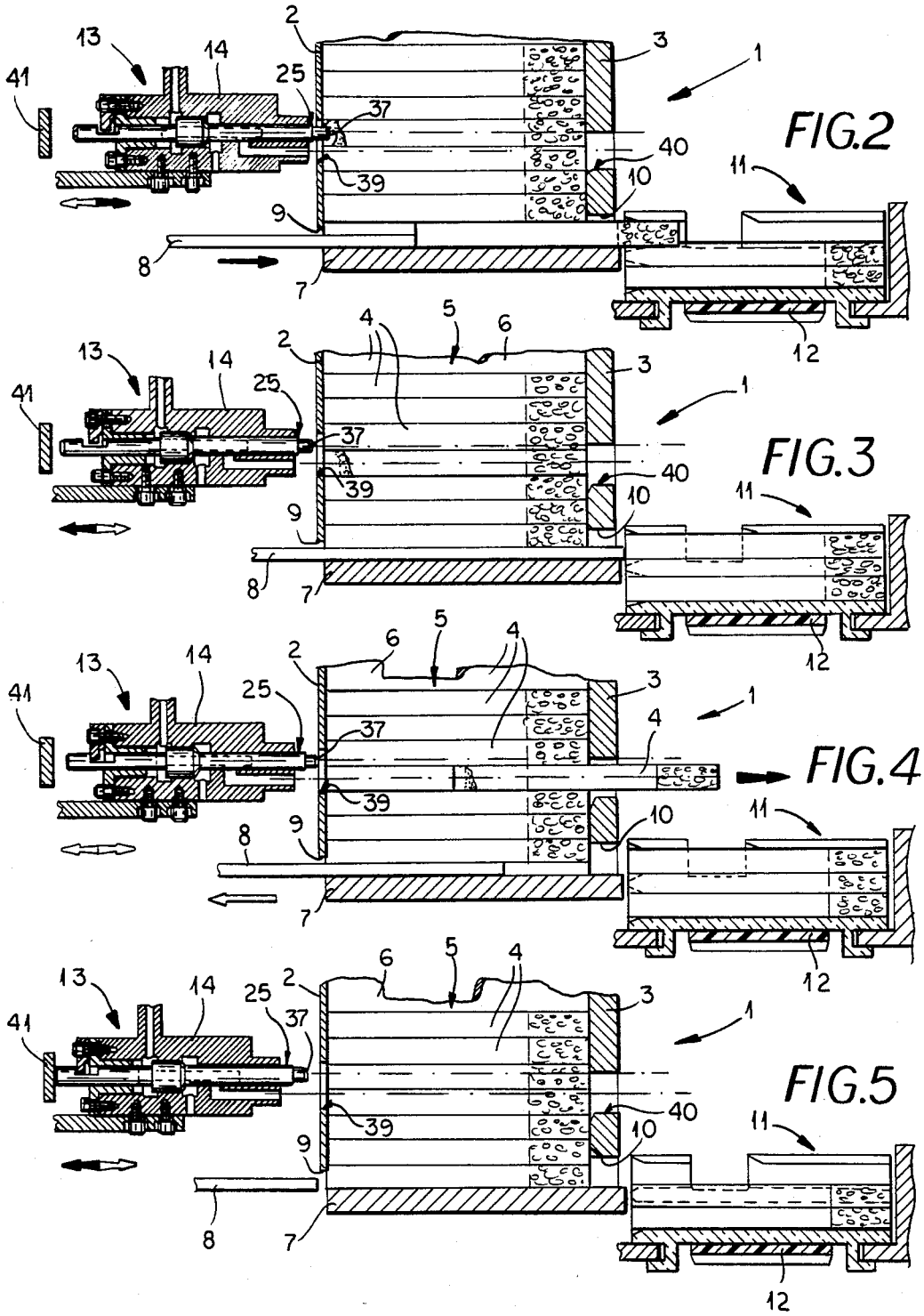
FIGS. 2 to 5 are diagrammatic sections of the device at four different operational stages.

In the position of the device shown in FIG. 2, each shaft 25 is disposed in the block 14 so as to maintain the wall 29 of the cylindrical section 28 inside the annular groove 20.

From this position the blocks 14 approach the hopper 1, bringing the respective sensor elements 37 into contact with the ends of the cigarettes axially aligned thereto.

The size of the displacement of the block 14 is such as to produce, in the case in which the cigarettes 4 do not oppose this, the penetration of a short section of the ends of the sensors 37 into the hopper 1. If the cigarettes being monitored have firm ends the penetration of the element is thereby prevented and the shafts 25 slide from right to left in the block 14 causing the cylindrical section 28 to completely cover the annular groove 20 and thus to interrupt communication between the hole 21 and the hole 34. The wall 3 of the hopper 1 constitutes, at this stage, an element opposing the action of the sensor element 37, preventing the cigarettes 4 from assuming irregular positions. In the case in which one or more sensor elements 37, on the other hand, contact, during the above-mentioned monitoring operations, cigarettes which are too short or whose ends are not adequately filled with tabacco, the shaft 25 maintains the initial position shown in FIG. 2 with respect to block 14, and the communication between the holes 21 and 34 is not interrupted, as the said sensor elements 37 have not been displaced towards the plate 41.

Whilst the feed elements 8 is completing the extraction of a layer of cigarettes 4 from the hopper 1, the blocks 14 move in translation towards the plate 41 (FIG. 3) by a distance which is such as to prevent the plate 41 itself being reached by the shafts 25.

The cigarettes 4 contained in the channels 5 meanwhile move along these channels by a distance substantially equal to their radius until they rest on the upper surface of the feed element 8. The said rotary valve 23 then causes the compressed air source 24 to communicate with the holes 21 which, in accordance with the above description, communicate with the respective conduits 36 only in case in which a cigarette which is too short or whose end is not filled is detected.

Consequently, a blast of compressed air strikes the left-hand side 29 of the cylindrical section 28 and causes a translation, limited by the guide and end of stroke elements 31-33, of the associated shafts 25 towards the wall 2 (see FIG. 4).

A blast of compressed air is simultaneously transmitted through the said conduits 36 and axially strikes the cigarettes 4 detected as defective and causes their ejection from the hopper 1 via the apertures 40.

The undesired discharge from the hopper 1 of cigarettes 4 adjacent to those cigarettes ejected cannot take place, in accordance with the description of the limiting effect of the wall 3, as a result of the said configuration of the apertures 40 and the position of their upper edges.

A successive translation of the blocks 14 (FIG. 5), such as to bring the ends 30 of the shafts 25 into contact with the plate 41, causes the shafts 25 to slide towards the wall 2, resetting the initial operating conditions of the monitoring device 13.

It can be seen that if the feed element 8 described above is replaced by a plate having a thickness substantially equal to the diameter of a cigarette, the cigarettes 4 perform their cyclical movement in the channels 5 in a single stage instead of two. In this case the ejector element 36 assumes a maximum spacing with respect to the shaft 25, or at least a distance such as to enable its action on defective cigarettes in the dwell period immediately following that used for the monitoring operation.

A large number of variants may naturally be made to the device described, whilst retaining the principle that the operating cycles of the sensor element 37 and the ejector element 36 are included, with respect to each cigarette 4, in the same operating cycle of the said packing machine.

Figure 6:
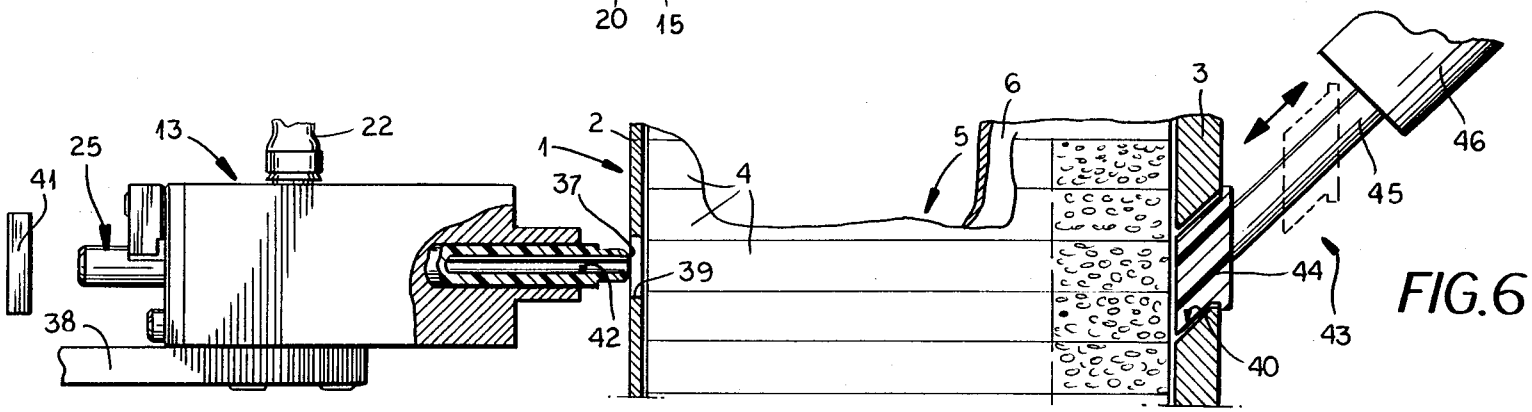
FIG. 6 is a diagrammatic section of a second embodiment of the device of the invention.

For example, in accordance with a variant of the device in question as shown in FIG. 6, the monitoring of the cigarettes and their possible ejection may be carried out at a same level. In this case the end portion facing the hopper 1 of each shaft 25 is traversed coaxially by a conduit 42 constituting an extension of the said conduit 34. The ejector element for the cigarettes 4 is therefore constituted by this conduit 42 and the said apertures 39 and 40 have the same level.

In order to prevent, during the monitoring stage for the cigarettes 4, the partial discharge of the latter through the apertures 40 as a result of the thrust exerted by the shafts 25, a limit means 43 operates in the vicinity of each aperture 40 and is designed to determine the respective closure or opening of the apertures 40 during each monitoring or ejection operation. The latter comprises a plate 44 parallel to the wall 3 supported by one end of a pin 45 which is inclined to horizontal and provided with an axial alternating movement with a predetermined phase relationship with the plate 38 by an actuation element 46.

The above description shows that the device of the invention enables, in a simple and reliable manner, the elimination of cigarettes which are too short or whose ends are not adequately filled with tobacco during their passage through the input hopper of a packing machine.

The notable simplicity of construction and the complete absence of memory or electrical circuit elements make the described device particularly strong and very reliable.

It should be finally noted that in order to prevent the non-removal of cigarettes having end defects in cases in which several defective cigarettes pass consecutively along the channels 5, the possibility of arranging a plurality of monitoring and ejection devices 13 along each channel 5 is provided.

I claim:

1. A device for monitoring the quality of cigarettes in an input hopper comprising:

a housing;

a compressed air supply communicating with said housing;

a shaft moveable axially in said housing for detecting a defective cigarette by pressure thereon;

an ejector nozzle formed in said housing trained on cigarettes in said hopper for ejecting defective cigarettes; and a valving body formed on said shaft for directly connecting said compressed air supply to said ejector nozzle.

2. The device defined in claim 1 wherein said ejector nozzle is formed in said shaft.

3. The device defined in claim 1 wherein said ejector nozzle is formed in said housing adjacent to and parallel to said shaft.

4. The device defined in claim 1 wherein said valving body comprises;

a channel;

a port formed in said housing communicating with said ejector nozzle; and a second port formed in said housing communicating with said air supply;

at least one of said ports being blocked closed by movement of said shaft upon detection of an acceptable cigarette.

5. The device defined in claim 1 wherein said housing has two coaxial cylindrical sections, a first coaxial cylindrical section of said coaxial cylindrical sections having a greater diameter than a second coaxial cylindrical section of said coaxial cylindrical sections.

6. The device defined in claim 1 having a removable blocking means at said hopper opposite said nozzle to prevent the ejection of acceptable cigarettes.

7. The device defined in claim 1 having resetting means for repositioning said shaft upon detection of an acceptable cigarette, said resetting means comprising a wall in the path of said shaft.

8. A device for monitoring the quality of cigarettes in an input hopper of a packing machine of the cyclic type, the said hopper being sub-divided at its output end into channels containing stacks of cigarettes adjacent in the horizontal direction and moving one step during each operating cycle of the said machine with a movement transverse to their respective axes along the said channels, the said device comprising, for each of the channels, at least one sensor element for sensing the quality of the cigarettes and a respective ejector element for defective cigarettes controlled by the said sensor element, the device being characterized in that said ejector element is disposed along the said channel in a position which is coincident with that of the said sensor element for the monitoring of each cigarette and the ejection of a defective cigarette within a same operating cycle of the said machine.

9. A device for monitoring the quality of cigarettes in an input hopper of a packing machine of the cyclic type, the said hopper being sub-divided at its output end into channels containing stacks of cigarettes adjacent in the horizontal direction and moving one step during each operating cycle of the said machine with a movement transverse to their respective axes along the said channels, the said device comprising a block moved with a reciprocating movement with respect to the said hopper parallel to the axes of the cigarettes supporting in a slideable manner in the direction of movement a sensor element, the said sensor element being rigid with control means designed to assume, on each forward stroke of the said block, two different positions for stopping and actuating, respectively, an ejector element, said ejector element comprises a conduit, said conduit is provided in the sensor element oriented parallel to the axes of the cigarettes, the said control means comprising distribution means connected by cyclical adjustment means to a compressed air source and to the said conduit.

* * * * *